United States Patent [19]

Iizuka et al.

[11] 4,134,261

[45] Jan. 16, 1979

[54] VARIABLE DISPLACEMENT CLOSED LOOP FUEL CONTROLLED INTERNAL COMBUSTION ENGINE

[75] Inventors: Haruhiko Iizuka, Yokosuka; Noburu Fukasawa, Kamakura, both of Japan

[73] Assignee: Nissan Motor Company, Limited, Japan

[21] Appl. No.: 824,849

[22] Filed: Aug. 15, 1977

[30] Foreign Application Priority Data

Sep. 13, 1976 [JP] Japan ..... 51-108876

[51] Int. Cl.[2] ..... F01N 3/15

[52] U.S. Cl. ..... 60/276; 60/277; 60/285; 60/299

[58] Field of Search ..... 60/276, 277, 285, 299

[56] References Cited

U.S. PATENT DOCUMENTS 3,955,363 5/1976 Manderscheid ..... 60/277

4,023,358 5/1977 Maurer ..... 60/277

FOREIGN PATENT DOCUMENTS 2242899 3/1974 Fed. Rep. of Germany ..... 60/299

*Primary Examiner*—Douglas Hart

*Attorney, Agent, or Firm*—Lowe, King, Price & Becker

[57] ABSTRACT

An internal combustion engine operable in variable displacement modes is provided with separate exhaust systems for individual cylinder groups and a set of exhaust gas sensor and catalytic converter for each exhaust system. An electronic fuel injection control unit is arranged to respond to one of the signals from the gas sensor which is indicative of mixture richer than the other to effect correction of the duration of fuel injection pulse. Each catalytic converter is provided with a temperature sensor to detect when the temperature therein falls below the normal catalytic reaction temperture. A variable displacement control unit responds to the output from the temperature sensors by alternately deactivating the cylinder groups during low power operation.

6 Claims, 5 Drawing Figures

TO INJECTORS #1~#3
TO INJECTORS #4~#6
J-K FF
MONO
R
S
Q
FROM ECU 19
FROM TEMP SENSOR T2
FROM TEMP SENSOR T1
27
28
29
30
33
34
40
41
42
43
44
45
46
47
48
49
50
51
52
53
54
55
56

VARIABLE DISPLACEMENT CLOSED LOOP FUEL CONTROLLED INTERNAL COMBUSTION ENGINE

BACKGROUND OF THE INVENTION

The present invention relates generally to multicylinder internal combustion engines of a variable displacement type in which a number of cylinders is deactivated in response to sensed engine load, and specificially it relates to a closed loop controlled electronic fuel injection of the variable displacement type in which separate exhaust systems and exhaust gas sensors are provided for separate cylinder groups.

Variable displacement internal combustion engines are known in the art to improve fuel economy by selectively shutting off fuel supply to several cylinders of the engine when reduced power output can operate the vehicle adequately. This variable displacement control is particularly advantageous for application to electronic fuel injection because the fuel injectors can be electrically disabled to cut off fuel without having the need for mechanical parts to shut off intake valves which would otherwise be required in carbureted engines. On the other hand, closed loop fuel control approach is known as an effective method for minimizing the harmful products HC, CO and NOx by maintaining air fuel ratio within a narrow range of catalytic conversion using a feedback signal obtained from an exhaust gas sensor. When closed loop controlled electronic fuel injection is operated in displacement mode where several cylinders are unfueled, the unfueled cylinders draw in air and exhaust the same through exhaust pipe where the exhaust gas sensor and catalytic converter are provided. Therefore, the gas sensor will generate a signal indicative of leaner mixtures than the mixture supplied to the working cylinders, and the air fuel ratio within the exhaust system will stray off the converter window where the catalyst simultaneously provides oxidation of unburned fuel and the reduction of nitrogen oxides. Thus, the closed loop fuel control cannot properly operate.

SUMMARY OF THE INVENTION

The primary object of the invention is to ensure that closed loop controlled electronic fuel injection can properly operate in variable displacement modes.

The present invention contemplates the use of separate exhaust systems associated with different cylinder groups and a set of exhaust gas sensor and catalytic converter for each exhaust system. Since the magnitude of voltage at the output of exhaust gas sensor is at a low value when unfueled, the valid sensor is derived from the one of the sensors which provides higher voltage signal than the other. The electronic fuel injection unit is arranged to respond to the higher voltage signal and processes the same to provide correction of the width of the injection pulse to adjust the ratio of air and fuel supplied to the working cylinders. Since the catalytic converter associated with the unfueled cylinder group is supplied only with air, reaction temperature will be lowered. Because of the cooling effect of the air, if the displacement mode of operation exists for an extended period of time, there will be hesitation of the converter in providing catalytic reaction when the associated cylinders are reactivated by power demand as well as hesitation in firing in the reactivated cylinders. To minimize the effects of hesitation, a temperature sensor is provided for each catalytic converter to detect the reaction temperature, and a variable displacement control unit is arranged to respond to the outputs from the temperature sensors to supply injection pulses alternately to a selected cylinder group when the reduced power can operate the vehicle adequately.

Another object of the invention is therefore to minimize the amount of harmful products generated during the transitory periods when the unfueled cylinders are reactivated by power demand by sensing the reaction temperature to alternately activate the unfueled cylinders and the associated catalytic converter to prevent them from being excessively cooled.

BRIEF DESCRIPTION OF THE DRAWINGS

The invention will be further described by way of example with reference to the accompanying drawings, in which.

DESCRIPTION OF THE PREFERRED EMBODIMENTS

Figure 1:
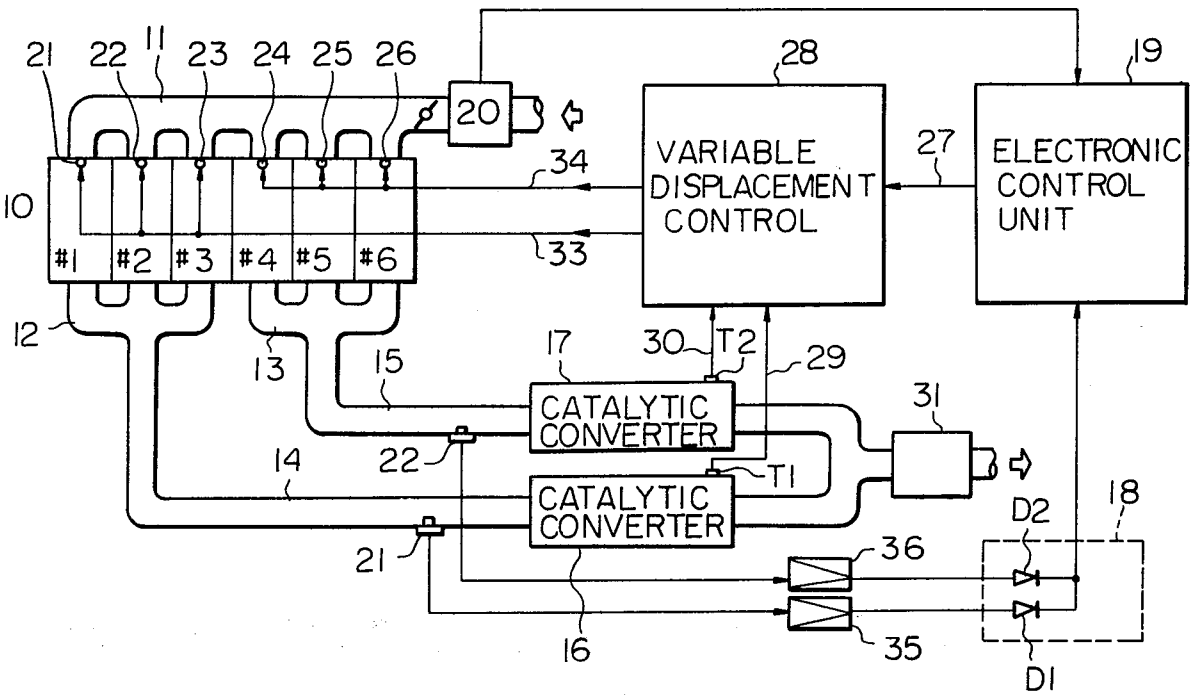
FIG. 1 is a schematic circuit diagram of an embodiment of the invention.

Referring now to the drawings and more particularly to FIG. 1, the reference numeral 10 designates a six cylinder internal combustion engine for a motor vehicle. The fuel that is supplied to the engine is controlled by six individual solenoid controlled injector valves 21, 22, 23, 24, 25 and 26, respectively. These injectors are located, for example, at the respective inlet valves for the six engine cylinders #1, #2, #3, #4, #5 and #6. Each injector, during energization, opens to discharge fuel from a source at constant pressure (not shown) so that the amount of fuel discharged in the region of each inlet valve is determined by the duration of valve opening, which in turn is controlled by the time duration of energization injection pulse.

In the fuel injection system shown in FIG. 1, the fuel injectors for the first three cylinders #1 to #3 are energized in unison by the injection pulses on lead 33. The injectors for the second three cylinders #4 to #6 are similarly energized in unison by the injection pulses on lead 34. During the intake stroke of each cylinder, the intake valve opens and the piston draws in fuel discharged from the injector and air through an intake manifold 11 and during the exhaust stroke the spent gases are discharged through separate exhaust manifolds 12 and 13. The exhaust manifold 12 is associated with the engine cylinders of the first group to transport their spent gases through a conduit 14 to a first catalytic converter 16. The exhaust manifold 13 is similarly associated with the engine cylinders of the second group to transport their spent gases through a conduit 15 to a second catalytic converter 17. These catalytic converters are of a three-way catalyst which displays an extremely narrow window of efficient operation, that is, the efficiency of three-way conversion deteriorates rapidly as an air-fuel ratio strays from stoichiometric. In the exhaust passages 14 and 15 are provided zirconia oxygen sensors Z1 and Z2, respectively, to detect the concentration of oxygen in the emissions from the first and second groups of cylinders and feed their outputs through amplifiers 35 and 36 to a comparator 18. The output from the zirconia sensor has a rapid change in amplitude as air-fuel ratio varies through stoichiometry so that it delivers a high voltage output for air-fuel ratios higher than stoichiometry and a low voltage output for ratios smaller than stoichiometry so that when the oxygen content is greater than normal the sensor output remains at low voltage level. The comparator 18 includes diodes D1 and D2 to compare the voltage signals from the zirconia sensors Z1 and Z2 and allows the signal which is higher in amplitude than the other to appear at the output. An electronic control unit 9 receives information from the comparator 18 as well as from sensors 20 that monitor key engine operating parameters such as intake air mass and throttle position to compute the exact fuel requirement for each cylinder on each engine cycle. The computation results are translated into injector-open time signals or injection pulses which are delivered through lead 27 to a variable displacement control unit 28.

The catalytic converters 16 and 17 are provided with temperature sensors T1 and T2, respectively, to detect the temperature of the exhaust emissions, the signals representing the detected temperatures being supplied to the variable displacement control unit 28 via leads 29 and 30, respectively, the outputs of the converters being connected together to muffler 31. The control unit 28 selects one of the cylinder groups in response to the output from the temperature sensors T1 and T2 and applies injection pulses to the injectors of the selected group over the lead 33 or 34.

Figure 2:
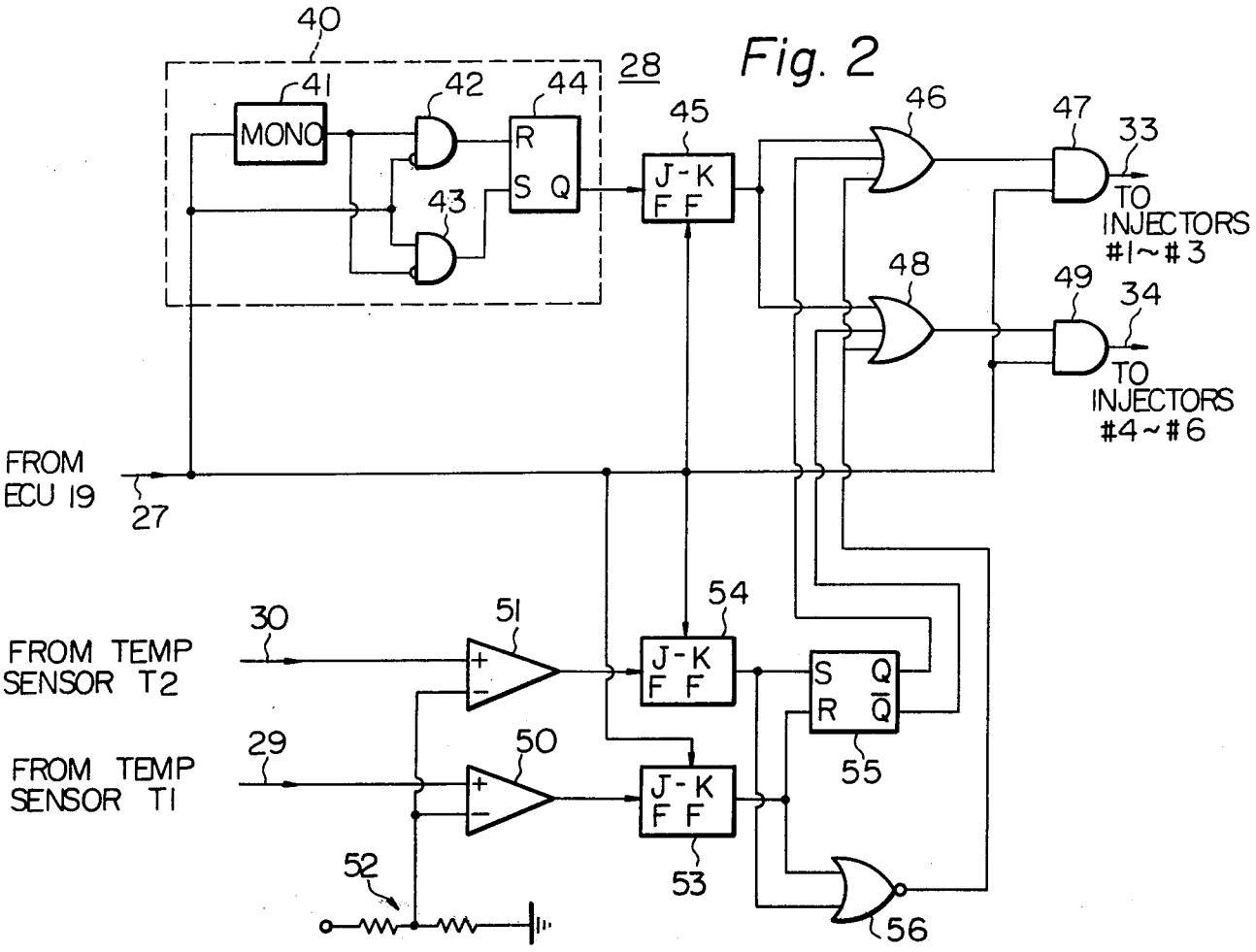
FIG. 2 is a detailed circuit diagram of the variable displacement control unit of FIG. 1.

FIG. 2 illustrates a detail of the variable displacement control unit 28 which is shown as including an engine load sensor 40. This load sensor includes a monostable multivibrator 41 which is connected to the lead 27 to provide an output pulse of constant or reference duration representing a medium value of engine load. The output from the monostable 41 coupled to the noninverted input of AND gate 42 and to the inverted input of AND gate 43 whose noninverted input is connected to the inverted input of AND gate 42 and also to the lead 27. When the injection pulse has a greater pulse width than the reference time duration set by the monostable 41, AND gate 43 will be activated to provide a "1" output to the set terminal of a flip-flop 44 which will be reset by a "1" output from AND gate 42 when the injection pulse duration becomes smaller than the reference duration. Therefore, the output of flip-flop 44 is an indication of whether the engine load is above or below the medium value. While the engine load sensor is shown as comprising a pulse width comparator it is to be understood that this sensor could equally as well be comprised by a suitable transducer located in the induction passage for sensing the intake vacuum which represents varying loads of the engine and other equivalents thereof.

A J-K flip-flop 45 receives the output from the engine load sensor 40 and changes its binary state at the falling edge of an injection pulse subsequent to the change in the binary state of the flip-flop 44. The output from the J-K flip-flop 45 is applied through OR gates 46 and 48 to AND gates 47 and 48, respectively, to which the injection pulses from the control unit 19 are also applied.

Comparators 50 and 51 are provided to compare the voltage signals from temperature sensors T1 and T2 with a fixed reference supplied from a voltage divider 52 to represent a temperature in the range between 400° C. to 600° C. The output of these comparators is driven to a high voltage level when the sensed temperature representative signal is above the fixed reference to cause J-K flips-flops 53 and 54 to change their binary states at the falling edge of an injection pulse subsequent to the change of states of the flip-flops 53 and 54.

A flip-flop 55 of a reset preference type is arranged to be set by the output from flip-flop 54 and reset by the output from flip-flop 53, the output terminals of flip-flop 55 being connected to OR gates 46 and 47, respectively.

A NOR gate 56 is provided to be responsive to the "0" output states of the J-K flip flops 53 and 54 to simultaneously enable AND gates 47 and 49 through OR gates 46 and 47.

AND gates 47 and 49 are simultaneously enabled by the output from the J-K flip-flop 45 indicating that the engine is under heavy load and by the output from the NOR gate 56 indicating that the temperature within both catalytic converters is below the reference temperature. Under these circumstances, injection pulses are supplied to all fuel injectors to provide full engine power. When the engine is at light load with the temperature within one of the catalytic converters being lower than the reference temperature, one of the AND gates 47 and 49 is enabled by the flip-flop 55 depending on which catalytic converter is below the reference temperature.

Figure 3:
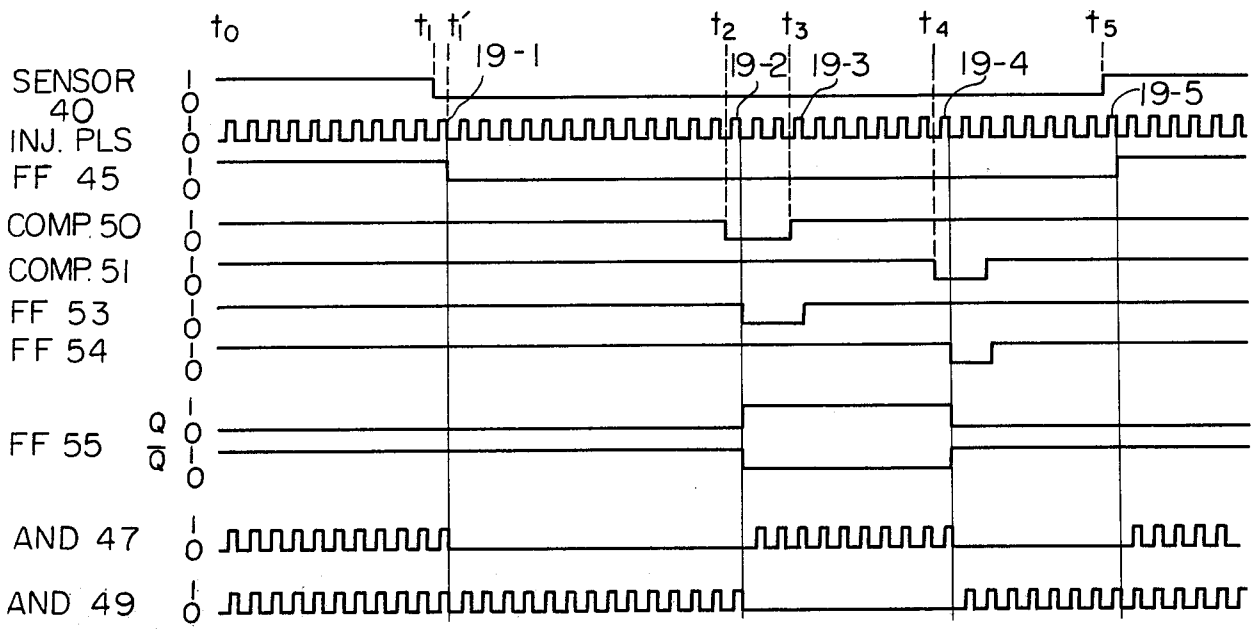
FIG. 3 is a series of voltage waveforms which illustrate graphically the operation of the system shown in FIG. 1.

The operation of FIG. 2 will be fully comprehended by reference to a timing diagram shown in FIG. 3. It is assumed that during time interval $t_0$ to $t_1$ the engine is at full load so that the output level of the engine load sensor 40 is at high voltage level. The J-K flip-flop 45 is in the high output state to enable AND gates 47 and 49 simultaneously. The flip-flop 45 changes its output state at time $t_1'$ at the trailing edge of an injection pulse 19-1 which occurs subsequent to time $t_1$. Injectors #1 to #6 are all activated during time interval $t_0$ to $t_1'$ to give full engine power. At this moment the temperature within the catalytic converters 16 and 17 are above the reference level represented by the voltage divider 52, flip-flop 55 is supplied at "1" signals on its set and reset inputs and its $\overline{Q}$ output remains at high voltage level which is coupled to the AND gate 49 to continue to activate injectors #4 to #6 while deactivating injectors #1 to #3. The engine thus enters 3-mode cylinder operation. As this 3-mode operation continues, the cylinders #1 to #3 draw in air and exhaust it through conduit 14 to catalytic converter 16. The oxygen content within the conduit 14 will become greater than the oxygen content within conduit 15, the zirconia sensor Z1 will provide a lower voltage signal than that provided from sensor Z2 so that diode D2 is rendered conductive to pass the signal from Z2 to the electronic control unit 19. The control unit 19 corrects the width of the injection pulse for cylinders #3 to #4 using the feedback signal provided from the second sensor Z2 which is operating within the normal operating temperature range. Therefore, feedback control operation for the cylinders #3 to #4 is not adversely affected by the deactivation of the cylinders #1 to #3.

Meanwhile, the temperature within catalytic converter 16 will continue to drop and at time $t_2$ the voltage at the noninverting input of comparator 50 falls below the setting level. At the trailing edge of an injection pulse 19-2 subsequent to time $t_2$, J-K flip-flop 53 switches to the output low state so that flip-flop 55 changes its output binary conditions. AND gate 47 is thus enabled to pass injection pulses to injectors #1 to #3 and injectors #4 to #6 are deactivated.

The temperature within the conduit 14 will then increase while the temperature within the conduit 15 will decrease so that electronic control unit 19 will receive the signal from the zirconia sensor Z1 when the signal from Z1 becomes greater in amplitude than the signal from Z2. Thus, feedback control operation is effected on the cylinders #1 to #3 using the feedback signal derived from the first zirconia sensor Z1.

At time $t_3$ the voltage signal from temperature sensor T1 rises above the setting level with the result that J-K flip-flop 53 switches to the output low state at the falling edge of an injection pulses 19-3 subsequent to time $t_3$. This change of states of flip-flop 53 has no effect on the binary states of flip-flop 55 so that injectors #1 to #3 remain periodically activated.

The cylinder groups will then be switched at time $t_4$ when the temperature within the catalytic converter 17 falls below the setting level causing J-K flip-flop 54 to be switched to the output low state at the falling edge of an injection pulse 19-4 subsequent to time $t_4$, and flip-flop 55 is caused to switch its output binary states in response to the output from J-K flip-flop 54.

As long as the engine load sensor 40 retains its low output condition, i.e., when reduced power can operate the vehicle adequately, the above-described process will be repeated to intermittently switch the deactivated cylinder groups and also intermittently switch the zirconia sensor signals to apply a valid signal to the electronic control unit 19. The intermittent switching of the deactivated cylinder group is to prevent the deactivated cylinders from being extremely cooled by the intake air inducted at each cylinder cycle as well as to prevent the associated catalytic converter from being cooled to a temperature below its operating temperature. Thus, there is no hesitation in firing when cylinders are reactivated by power demand and there is no hesitation in catalytic reaction in the converter when the associated cylinders are reactivated.

At time $t_5$, the engine demands full power and the load sensor 40 responds to it by generating a high voltage signal which will cause J-K flip-flop 45 to turn on by an injection pulse 19-5 subsequent to time $t_5$, thereby activating all the cylinders.

When low power operation exists for an extended period of time, it is possible that the temperatures within both catalytic converters might decrease below their operating points so that the outputs from J-K flip-flops are simultaneously at low voltage level. This condition is sensed by the NOR gate 56 which produces a "1" output to the AND gates 47 and 49 to activate all the cylinders until the catalytic converters reach their operating temperatures again.

Figure 4:
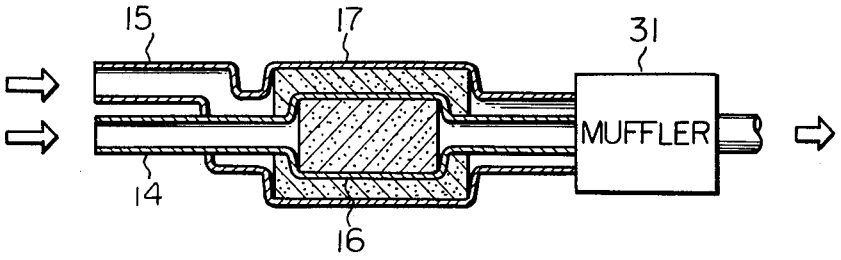
FIG. 4 is a modification of the embodiment of FIG. 1.

FIG. 4 is a cutaway view of a modified arrangement of the catalytic converters 16 and 17. In this modification, the catalytic converter 16 is located within the catalytic converter 17. This arrangement permits heat to be transferred from one catalytic converter to the other so as to average out the different temperatures between the converters.

It will be understood from the above that the J-K flip-flops 45, 53 and 54 are used as switching elements which determine an appropriate timing so that even a single bit of injection pulse is lost or mutilated in waveform as injector groups are switched alternately or nonworking injectors are switched into activation.

Figure 5:
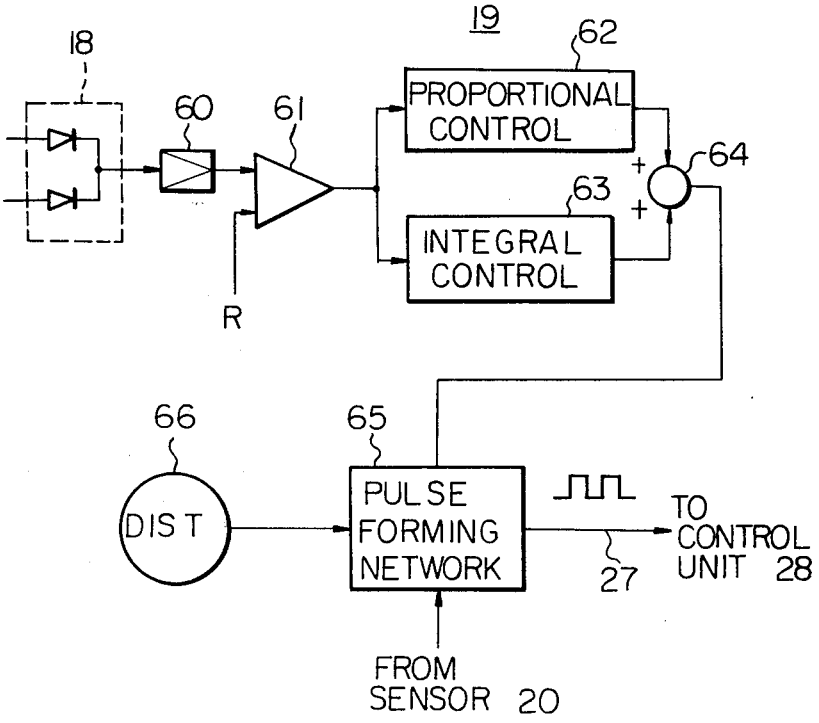
FIG. 5 is a detailed circuit block diagram of the electronic fuel injection control unit of FIG. 1.

FIG. 5 schematically illustrates an example of the circuitry of the electronic control unit 19 which determines the period of energization of each fuel injector during each cylinder cycle. The signal from the comparator 18 is amplified at 60 and coupled to the noninverting input of a comparator 61 for comparison with a fixed reference R applied to its inverting input, the reference R representing an air fuel ratio in the vicinity of the stoichiometry corresponding to a value in the narrow range of converter window. The output from the comparator 61 represents the deviation of the ratio of air and fuel contained in the gases in one of the exhaust systems 14 and 15 depending on which output level of the zirconia sensor is greater then the other.

A proportional control amplifier 62 receives the output from comparator to provide appropriate proportional amplification on the deviation representative signal. The output from the comparator 61 is also received by an integral control amplifier 63 which provides integration of the input signal with an appropriate integration or ramp rate. The summation of the two outputs from said control amplifiers is obtained at a summing point 64, whose output is applied to a pulse forming network 65. The pulse forming network 65 generates an injection pulse in receipt of a signal from the engine distributer 66. The duration of the injection pulse is determined by the voltage of the signal received from the summing junction 64 as well as the signal from sensor 20 so that various engine operating conditions are reflected in the pulse duration and hence the opening time of each fuel injector. The result is a rectangular waveform shown in FIG. 5 which is synchronized with the engine crankshaft revolution.

Referring now back to FIG. 1, cylinders #3 to #6 are assumed to be deactivated, with the result that the zirconia sensor Z1 generates a valid oxygen concentration representative signal. The electronic control unit 19 is in receipt of the signal from zirconia sensor Z1 and processes the received signal to correct the width of the injection pulse in a manner as described above. The width corrected injection pulse is applied through the variable displacement control unit 28 and thence to the fuel injectors 21, 22 and 23 via conductor 33. The cylinders #1 to #3 are thus supplied with air and fuel in a certain ratio determined by the duration of the injection pulse and this air fuel ratio is reflected in the air fuel ratio of the gases in the exhaust pipe 14, which is sensed by sensor Z1 to provide a feedback correction signal to be used in adjusting the ratio of air and fuel supplied for subsequent firing operation. Under these circumstances, the signal from zirconia sensor Z2 is disabled and the first cylinder group is operated under feedback control using the signal from the associated sensor Z1 so that the catalytic converter 16 is supplied with gases containing air and fuel in a ratio corresponding to a valve in the narrow converter window, thereby minimizing the amount of noxious components in the spent gases during low power operation.

When the engine demands full power all the cylinders are switched into operation and zirconia sensor Z2 starts to generate valid signal which is compared with the signal from Z1.

What is claimed is:

1. A multi-cylinder internal combustion engine having first and second cylinders and first and second electrically energizable fuel injectors respectively for said cylinders adapted when energized to discharge fuel thereinto and an air intake passage for said cylinders, comprising:

first and second exhaust systems associated with said first and second cylinders respectively;

first and second means for respectively generating first and second signals indicative of the air fuel ratio within said first and second exhaust systems respectively;

first and second catalytic converters disposed in said first and second exhaust systems respectively, and effective when supplied with exhaust gases containing air and fuel in a certain ratio to accelerate simultaneously the oxidation of unburned fuel and the reduction of nitrogen oxides when said exhaust gases are within an effective range of temperatures;

first and second temperature sensors for detecting when said exhaust gases in said first and second catalytic converters are within said effective range of temperatures;

means operable when said engine is at light load to selectively energize one of said first and second fuel injectors in synchronism with operation of the engine in response to the time of occurrence of an output from said first and second temperature sensors and operable when said engine is at heavy load to simultaneously energize said first and second fuel injectors in synchronism with operation of the engine, and adjusting the period of energization of said fuel injectors in accordance with the one of said first and second signals which is indicative of the air-fuel ratio within one of the exhaust systems being richer than the air-fuel ratio within the other exhaust system, whereby the ratio of air and fuel supplied to said cylinders is varied in response to the direction of the deviation of said one of said first and second signals from a fixed reference so as to reduce the deviation of the ratio of air and fuel in the respective exhaust systems from said certain ratio.

2. A multi-cylinder internal combustion engine as claimed in claim 1, further comprising means for simultaneously energizing said first and second fuel injectors in response to the outputs from said first and second temperature sensors when the exhaust gases in said first and second exhaust systems are below said effective ranges.

3. A multi-cylinder internal combustion engine as claimed in claim 1, wherein said first catalytic converter is located within said second catalytic converter to permit exchange of heat between said converters.

4. A multi-cylinder internal combustion engine as claimed in claim 1, wherein said injector energizing and period adjusting means comprises:

means for generating an electrical signal at one of first and second binary levels when the engine is at light or heavy load, respectively;

means for generating an injection pulse in synchronism with the revolution of the engine, the duration of the injection pulse being dependent upon the voltage of said one of said first and second signals;

a first J-K flip-flop operable to change its binary state in response to the trailing edge of an injection pulse which occurs subsequent to the time of occurrence of said electrical signal at one of first and second binary levels;

a second J-K flip-flop operable to change its binary state in response to the trailing edge of an injection pulse which occurs subsequent to the time of occurrence of said output from said first temperature sensor;

a third J-K flip-flop operable to change its binary state in response to the trailing edge of an injection pulse which occurs subsequent to the time of occurrence of said output from said second temperature sensor;

a bistable device responsive to the outputs from said second and third J-K flip-flops to change its binary states; and first and second AND gates for selectively feeding said injection pulse to said first and second fuel injectors in response to the binary states of said bistable device and in response to the binary state of said first J-K flip-flop.

5. A multi-cylinder internal combustion engine having first and second cylinders and first and second electrically energizable fuel injectors respectively for said cylinders adapted when energized to discharge fuel thereinto, and an air intake passage for said cylinders, comprising:

first and second exhaust systems associated with said first and second cylinders respectively;

first and second means for respectively generating first and second signals indicative of the air fuel ratio within said first and second exhaust systems respectively;

first and second catalytic converters disposed in said first and second exhaust systems respectively, and effective when supplied with exhaust gases containing air and fuel in a certain ratio to accelerate simultaneously the oxidation of unburned fuel and the reduction of nitrogen oxides when said exhaust gases are within an effective range of temperatures;

first and second temperature sensors for detecting when said exhaust gases in said first and second catalytic converters are within said effective range of temperatures;

means for energizing said fuel injectors for a period of time dependent upon the one of said first and second signals which is greater in magnitude than the other such that the ratio of air and fuel supplied to said cylinders is varied in the direction of the deviation of said one of said first and second signals from a fixed reference to reduce the deviation of the ratio of air and fuel in the respective exhaust systems from said certain ratio; and means operable when said engine is at light load to alternately deactive one of said first and second fuel injectors in response to the time of occurrence of an output from said temperature sensors.

6. A multi-cylinder internal combustion engine having first and second cylinders and first and second electrically energizable fuel injectors for said cylinders respectively adapted when energized to discharge fuel thereinto, comprising:

a variable displacement control means including first and second exhaust systems associated with said first and second cylinders respectively, first and second catalytic converters respectively disposed in said first and second exhaust systems, said converters being effective when supplied with exhaust gases containing air and fuel in a certain ratio to accelerate simultaneously the oxidation of unburned fuel and the reduction of nitrogen oxides when said exhaust gases are within an effective range of temperatures, first and second temperature sensors for detecting when said exhaust gases in said first and second catalytic converters are within said effective range of temperatures, and a control unit operable when the engine is at light load to selectively respond to the time of occurrence of an output from said first and second temperature sensors to energize one of said first and second fuel injectors and operable when the engine is at heavy load to energize said first and second fuel injectors simultaneously; and a closed loop fuel control means including means for generating a first signal indicative of the air fuel ratio within said first exhaust system upstream from said first catalytic converter, means for generating a second signal indicative of the air fuel ratio in said second exhaust system upstream from said second catalytic converter, and means for adjusting the period of energization of said fuel injectors in accordance with the one of said first and second signals which is greater in magnitude than the other to vary the ratio of air and fuel supplied to said cylinders in response to the direction of the deviation of said one of said first and second signals from a fixed reference so as to reduce the deviation of the ratio of air and fuel in the respective exhaust systems from said certain ratio.

* * * * *